US007014476B2

(12) United States Patent
Ohtsuki et al.

(10) Patent No.: US 7,014,476 B2
(45) Date of Patent: Mar. 21, 2006

(54) ELECTRICAL CONNECTOR

(75) Inventors: Tomonari Ohtsuki, Tokyo (JP); Kazuyuki Ozai, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/104,182

(22) Filed: Apr. 11, 2005

(65) Prior Publication Data

US 2005/0233612 A1 Oct. 20, 2005

(30) Foreign Application Priority Data

Apr. 16, 2004 (JP) ..... 2004-120960

(51) Int. Cl.
*H01R 12/00* (2006.01)

(52) U.S. Cl. ..... 439/67; 439/66; 439/91

(58) Field of Classification Search ..... 439/66, 439/67, 91, 591
See application file for complete search history.

(56) References Cited

U.S. PATENT DOCUMENTS 4,548,451 A * 10/1985 Benarr et al. ..... 439/66
5,842,877 A * 12/1998 M.ang.rtensson et al. ..... 439/91
5,984,691 A * 11/1999 Brodsky et al. ..... 439/66
6,027,346 A * 2/2000 Sinsheimer et al. ..... 439/66
6,442,039 B1 * 8/2002 Schreiber ..... 439/66
6,524,115 B1 * 2/2003 Gates et al. ..... 439/66
6,830,463 B1 * 12/2004 Keller ..... 439/91
6,857,880 B1 * 2/2005 Ohtsuki et al. ..... 439/66
2001/0011907 A1 * 8/2001 Farnworth et al. ..... 324/765
2003/0003779 A1 * 1/2003 Rathburn ..... 439/66

* cited by examiner

*Primary Examiner*—Tho D. Ta
(74) *Attorney, Agent, or Firm*—Abelman, Frayne & Schwab

(57) ABSTRACT

An electrical connector includes an elastomer in the form of a layer, and a plurality of fine conductive wires embedded in the elastomer and extending rectilinearly in vertical directions to front and rear surfaces of the elastomer. The fine conductive wires have an overall length substantially the same as or slightly larger than the thickness of the elastomer so that both the ends of the fine conductive wires extend from the front and rear surfaces of the elastomer. The electrical connector includes a flexible printed circuit board connected to the fine conductive wires. The flexible printed circuit board includes at least three electric contacts arranged substantially concentrically around and electrically connected to each of the fine conductive wires. With this arrangement, the electrical connector enables a stable inspection for integrated circuit pads in a manner which minimizes irregularities in repeatedly measured values of electric resistance and skew.

20 Claims, 4 Drawing Sheets

ELECTRICAL CONNECTOR

BACKGROUND OF THE INVENTION

This invention relates to an electrical connector for use in inspecting integrated circuits used in high-speed transmission as in mobile phones, and more particularly to an electrical connector capable of minimizing irregularities in measured values of electrical characteristics of integrated circuit pads even if contact points of contacts of the connector on the pads are unexpectedly shifted.

In inspecting integrated circuits, a hemispherical or other shaped electrical contact provided on a connector has been brought into contact with an integrated circuit pad at a single point to perform its inspection in the past as explained in the following patent literatures. For example, in Japanese Patent Application No. 2002-228,911 (Patent Literature 1), belonging to the applicant of the present application has proposed an electrical connector which is well-adapted to high-speed transmission signals and enables a reliable connection between fine conductive wires 20 and a flexible printed circuit board 18 without any need to give an attention to lengths of the fine conductive wires and without any risk of the flexible board being deflected or warped. In the proposed electrical connector, connection portions of conductors can be readily connected to the flexible printed circuit board 18 even if circumferences of the connection portions to be electrically connected are covered by insulators. The electrical connector achieves such effects by comprising an elastomer layer 22, a plurality of fine conductive wires 20 embedded in the elastomer layer 22 and extending rectilinearly therein at right angles to both surfaces of the elastomer layer, and recesses 26 being formed in the elastomer layer 22 around peripheries of openings of holes in which the fine conductive wires are embedded. This patent application further discloses a feature of clamping the flexible printed circuit board 18 and the elastomer layer 22 by means of restraining jigs 32 when the flexible circuit board 18 and the fine conductor wires 20 of the elastomer are electrically connected by vapor reflow soldering, thereby preventing the connection portions of the flexible printed circuit board at both the surfaces from moving away from the elastomer 22.

The applicant of the present application has also proposed an electrical connector for inspecting chips to reduce its cost remarkably in Japanese Patent Application No. 2003-133,231 (Patent Literature 2). For chips obtained by individual dicing of wafers, it is required to identify front and rear faces, top and bottom, and right and left of the chip preparatory to measurement of characteristics so that expensive means for such an identification are required as well. Based on the recognition that the cost can be remarkably reduced by performing the inspection under the state of wafers, the applicant has proposed the following features in that application. A plurality of fine conductive wires 20 are embedded in an elastomer layer 22 to extend rectilinearly therein at right angles to both surfaces of the elastomer layer. The elastomer layer 22 is formed with recesses 26 around peripheries of openings of holes in which the fine conductive wires 20 are embedded, respectively. The overall lengths of the fine conductive wires 20 are substantially equal to or slightly larger than the thickness of the elastomer 22 so that both the ends of the wires 20 slightly extend from the both surfaces of the elastomer 22. A flexible printed circuit board 18 having electric contacts 12 is connected to the fine conductive wires 20 of either of the surfaces of the elastomer 22, or a hard board or substrate 30 is connected to the surface of the elastomer opposite to the surface connected to the flexible printed circuit board 18.

Moreover, Japanese Patent Application Opened No. H10-69,955 (1998) (Patent Literature 3) discloses an integrated circuit socket for inspecting integrated circuits having projection electrodes such as bump electrodes, a testing method using the integrated circuit socket, and an integrated circuit socket mounting mechanism. The integrated circuit socket is mounted on a test substrate 32 for performing the tasting of the integrated circuit with a high accuracy without damage to the miniaturized projection electrodes, and is adapted to be provided with the integrated circuit 25 having solder bumps 28 to be tested. The integrated circuit socket comprises a contact unit 23 consisting of a plurality of straight contact pins 30 whose lower ends are electrically connected to the test substrate 32 and upper ends are connected to the solder bumps 28, and an elastic member 31 supporting these contact pins 30. Further, the contact pins 30 have a fine diameter capable of piercing the solder bumps 28 so that their electrical connection can be achieved by the piercing thereinto.

Furthermore, Japanese Patent Application Opened No. H11-297,444(1999) (Patent Literature 4) discloses a test socket which attempts to eliminate problems associated with test socket arrangement of the prior art. The test socket for integrated circuit packages of the opened application comprises an upper housing and a lower housing clamped to the top and bottom surfaces of a mounting substrate, respectively. The upper housing includes a cavity for receiving an integrated circuit package and holes at the bottom of the upper housing for bringing a plurality of solid socket plungers into contact with testing positions of the integrated circuit package. The socket plungers are arranged in a plurality of grooves formed in the lower housing and extend through a plurality of holes of the mounting substrate to contact the test positions. A plurality of springs are arranged in the plurality of grooves of the lower housing under the plungers to resiliently urge the plungers upwardly with the aid of balls arranged between the springs and inclined end faces of the plungers.

Japanese Patent Application Opened No. 2000-8,749 (Patent Literature 5) discloses an electrical connector which intends to prevent irregularities in resistances at connection portions, to stabilize the connection of electrodes and to prevent excess deformation by compression. This opened application further discloses a connection structure using this electrical connector, and a semiconductor socket and a method for producing the same. The connection structure comprises a fitting plate 8 interposed between a mounting circuit board 4 and a semiconductor package 30, an electrical connector 12 to be fitted in the fitting plate 8, and a positioning plate 17 overlapping the fitting plate 8. The electrical connector 12 comprises an elastic insulating sheet 13 to be fitted in the fitting plate 8, a plurality of elastic connection elements 14 arranged at a predetermined interval and extending from the elastic sheet 13 toward the semiconductor package 30, and a plurality of metal ribbons 15 built-in the respective elastic connection elements 14 so as to correspond to the mounting circuit board 4 and a plurality of electrodes 5·31 of the semiconductor package 30 in a manner achieving the continuity between the mounting circuit board 4 and the electrodes 5·31 of the semiconductor package 30. The respective metal ribbons 15 are straight inclined in the same direction as the opposed direction of the mounting circuit board 4 and the semiconductor package 30, and the positioning plate 17 is formed with position correcting slits 18 through which the respective elastic connection elements 14 extend.

Japanese Patent Application Opened No. H6-243,940 (1994) (Patent Literature 6) discloses a CDDI connector whose electrical characteristics are improved to comply the requirements imposed on high-speed network parts. This opened specification discloses the feature of arranging contacts 13 of the connector (CDDI connector) for a high-speed network for transmitting audio and data signals on an inner circle 3 and an intermediate circle 2.

In the method for inspecting an integrated circuit pad having a certain size by bringing only a single contact of a connector for the inspection into contact with the pad as in the patent literatures 1 to 5 described above, the conductive path length will be changed depending upon contacting positions of the single contact on the pad. Consequently, there would be a tendency of irregularities in measured values such as disclosed electric resistance values and skews to occur in the inspection, resulting in unstable inspection.

SUMMARY OF THE INVENTION

It is an object of the invention to provide an improved electrical connector which eliminates the disadvantages of the prior art and which enables stable inspection for integrated circuit pads in a manner minimizing irregularities in measured values such as electric resistance value and skew.

The above object can be achieved by an electrical connector according to the invention comprising an elastomer 22 in the form of a layer; a plurality of fine conductive wires 20 embedded in the elastomer 22 and extending rectilinearly in vertical directions to front and rear surfaces of the elastomer, the fine conductive wires having an overall length substantially the same as or slightly larger than the thickness of the elastomer so that both the ends extend from the front and rear surfaces of the elastomer; and a flexible printed circuit board 18 connected to the fine conductive wires 20, and the flexible printed circuit board comprising at least three electric contacts 12 arranged substantially concentrically around and electrically connected to each of the fine conductive wires.

In a preferred embodiment of the invention, the elastomer 22 is formed with a recess 26 at the periphery of a hole in which each of the fine conductive wires 20 is embedded. By providing the recesses 26 at the peripheries of the through-holes in the elastomer, the elastomer 22 is prevented from swelling at the ends of the fine conductive wires 20 so that even if the fine conductive wires have a reduced diameter portion or portions, their shoulders are never covered by the elastomer 22.

One embodiment of the invention, the flexible printed circuit board is formed with a substantially U-shaped slit 16 around each of the electric contacts 12. By providing a substantially U-shaped slit 16 around each of the electric contacts, the respective electric contacts are resiliently supported by parts of the flexible board surrounded by the slit in a cantilevered manner so that the electric contacts can easily follow any inclination and unevenness of the integrated circuit pads, thereby effectively performing the inspection of integrated circuit pads.

According to the invention at least three electric contacts 12 are arranged on the flexible printed circuit board so as to contact one pad. With this arrangement, even if the center of the pad is shifted from the center of the electric contacts 12, there are electric contacts located at larger distance and at smaller distance from the center of the pad so that the mean distance between the center of the pad and the centers of the electric contacts 12 remains substantially the same, thereby minimizing irregularities in measured electric resistance value, impedance and skew.

According to the invention, a flexible printed circuit board or boards 18 are connected to either or both of the front and rear surfaces of the elastomer 22. Moreover, when the flexible printed circuit board 18 is connected to either of the front and rear surfaces of the elastomer, a hard board is connected to the remaining surface of the elastomer.

As can be seen from the above explanation, the electrical connector 10 according to the invention can bring about the following significant effects.

(1) According to the invention, the electrical connector comprises an elastomer 22 in the form of a layer; a plurality of fine conductive wires 20 embedded in the elastomer 22 and extending rectilinearly in vertical directions to front and rear surfaces of the elastomer, the fine conductive wires having an overall length substantially the same as or slightly larger than the thickness of the elastomer so that both the ends extend from the front and rear surfaces of the elastomer; and a flexible printed circuit board 18 connected to the fine conductive wires 20, and the flexible printed circuit board comprises at least three electric contacts 12 arranged substantially concentrically around and electrically connected to each of the fine conductive wires. Therefore, even if the contacting positions of the electric contacts on an integrated circuit pad are shifted from predetermined positions, irregularities in repeatedly measured values as electric resistance value, impedance and screw are little so that stable inspection is possible.

(2) According to the invention, the elastomer 22 is formed with a recess 26 at the periphery of a hole in which each of the fine conductive wires is embedded. Accordingly, in the case that the fine conductive wires 20 are pins having a reduced diameter portion or portions, the shoulders of the pins are not covered by the elastomer 22, thereby preventing bending by deformation of the elastomer.

(3) According to the invention, the flexible printed circuit board is formed with a substantially U-shaped slit 16 around each of the electric contacts 12. The electric contacts are flexibly supported in a cantilevered manner so that the electric contacts can easily follow possible inclination and unevenness of the pads.

(4) According to the invention, at least three electric contacts 12 are arranged on the flexible printed circuit board so as to contact one pad. Consequently, in the case that the electric contacts 12 are shifted from the center relative to an integrated circuit pad to be inspected, there are electric contacts 12 at longer distances and shorter distances to the center of the pad so that mean distance from the electric contacts to the center of the pad remains substantially constant, namely the relative distances are not changed thereby reducing irregularities in repeatedly measured values, such as electric resistance value, impedance and skew.

(5) According to the invention, a flexible printed circuit board or boards are connected to either or both of the front and rear surfaces of the elastomer 22. Therefore, the electrical connector can be readily connected to a flexible printed circuit board 18 suitable for high-speed transmission. Accordingly, insertion losses can be significantly reduced as a socket connector for measuring and inspecting high-speed signals.

(6) According to the invention, when the flexible printed circuit board 18 is connected to either of the surfaces of the elastomer, a hard board is connected to the remaining surface of the elastomer so that contact portions to be contacted extend to the foremost end, thereby easily achieving contacting to integrated circuit contact elements in a state of wafers.

The invention will be more fully understood by referring to the following detailed specification and claims taken in connection with the appended drawings.

DESCRIPTION OF THE PREFERRED EMBODIMENTS

Figure 1:
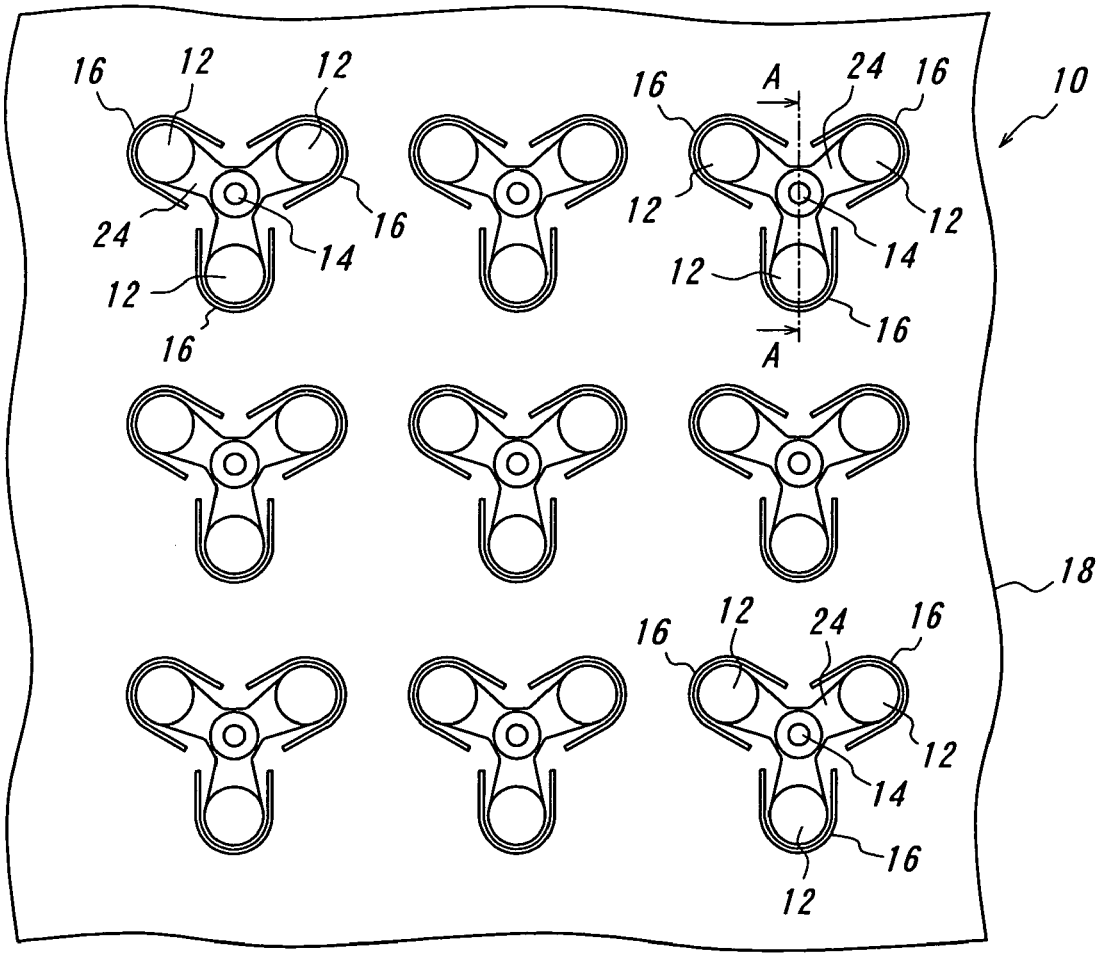
FIG. 1 is a plan view of the electrical connector according to the invention.
Figure 2:
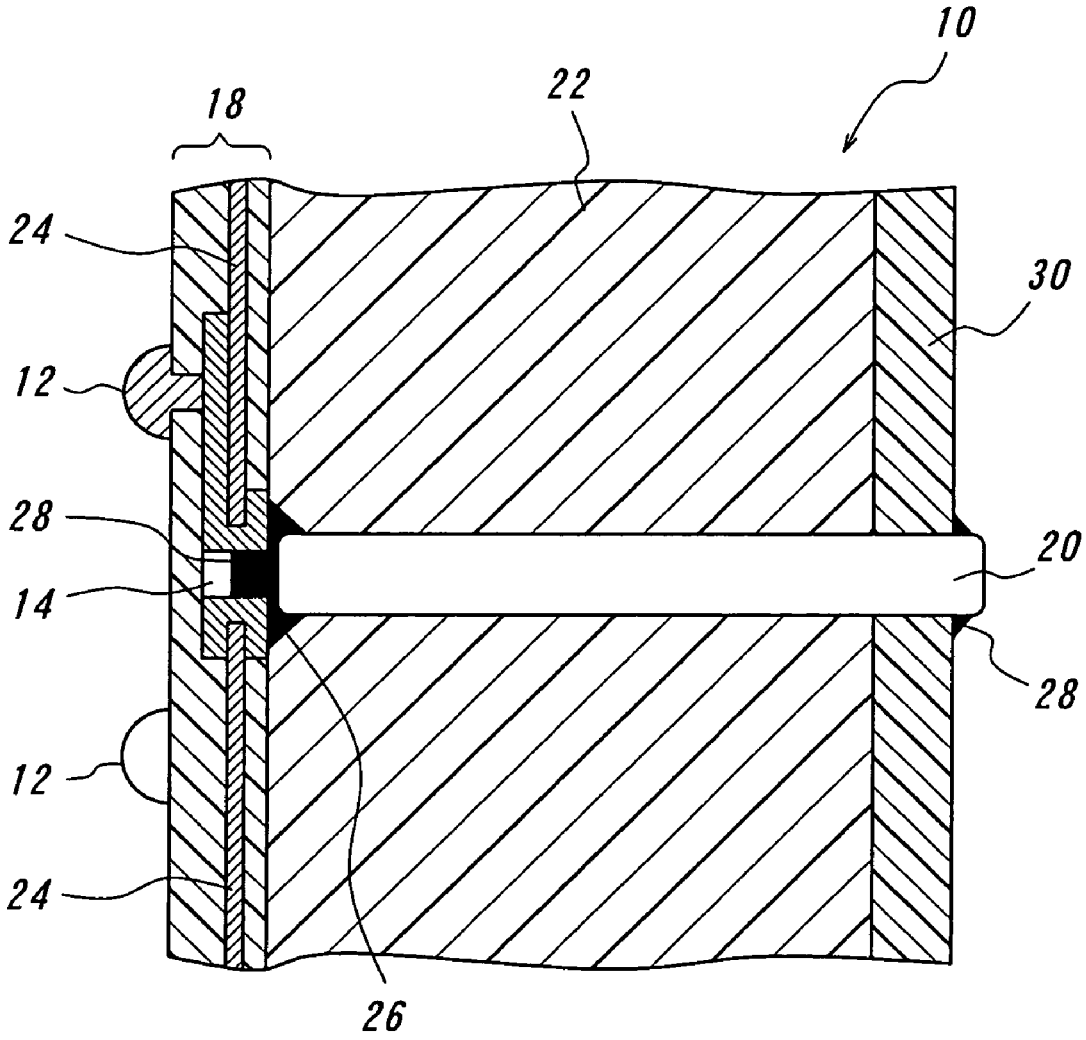
FIG. 2 is a partly longitudinal sectional view of the electrical connector taken along the line A—A in FIG. 1.

The electrical connector 10 according to the invention will be explained in detail with reference to FIGS. 1 to 3. FIG. 1 is a plan view of the connector according to the invention and FIG. 2 is a partly longitudinal sectional view of the electrical connector taken along the line A—A in FIG. 1.

Figure 3:
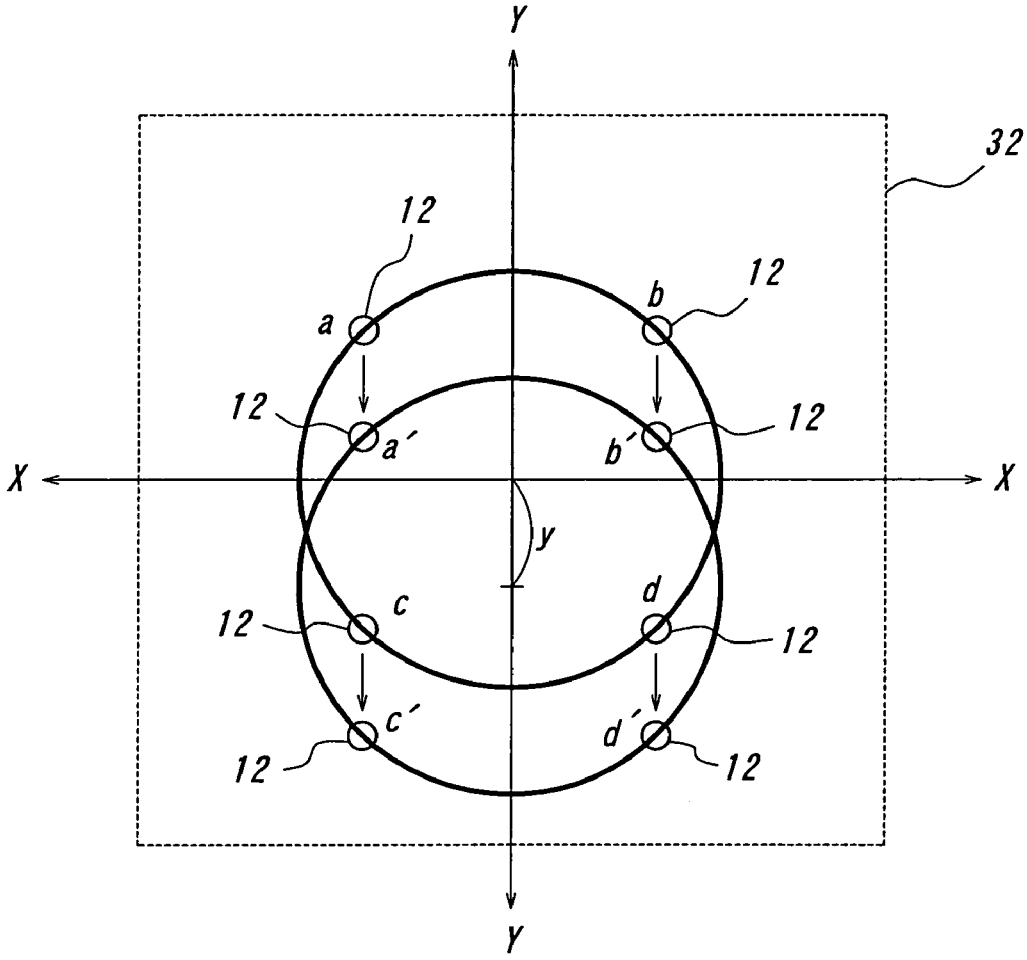
FIG. 3 is an explanatory view in the case of electric contacts being shifted from the center of an integrated circuit pad.

FIG. 3 is a view for explaining variations in measured values caused by positional shifting of electric contacts from the center of an integrated circuit pad.

The electrical connector 10 according to the invention serves to inspect high-speed operating integrated circuits such as LGA, BGA and the like. The electrical connector 10 mainly comprises an elastomer 22, fine conductive wires 20 and a flexible printed circuit board 18.

Prior to explanation of the respective components of the connector, the high-speed operating integrated circuit to be inspected by the electrical connector 10 will be explained. The high-speed operating integrated circuit may be mounted on a board or substrate and have been miniaturized, for example, to a square having a side of less than 10 mm with miniaturization of electronic appliances. Integrated circuit pads to contact the electric contacts 12 have also become, for example, a very small square having a side of the order of 1.5 mm. For known good dies, it is required to inspect the high-speed operating integrated circuits with respect to their electric resistance value, impedance and skew. The electrical connector 10 according to the invention is advantageously used for such an inspection.

The respective components of the connector will be explained hereinafter. First, the flexible printed circuit board 18 will be explained which forms subject features according to the invention. The flexible printed circuit board is formed with a plurality of through-holes 14 which may be actually through-holes or holding holes. The fine conductive wires 20 are connected to the through-holes 14. At least three electric contacts 12 are concentrically arranged around each of the through holes 14. Conductors 24 or the like are arranged between the electric contacts 12 and the through-hole 14 for achieving the continuity therebetween. The at least three electric contacts 12 concentrically arranged are positioned so as to contact one pad to be inspected.

The number of the electric contacts 12 may be arbitrary in sofar as it is not less than three. However, it is better to be as many as possible in order to prevent irregularities in electric resistance value, impedance and skew to be measured or inspected. The number of the electric contacts is suitably designed in consideration of the workability, and irregularities in electric resistance value and skew in inspection.

The electric contacts 12 of not less than three are preferably arranged spaced apart from one another at an equal distance as possible with a view to obtaining minimum irregularities in electric resistance value and skew in inspection. In the illustrated embodiment, the three electric contacts 12 are concentrically arranged and equally circumferentially spaced at 120 degrees as shown in FIG. 1.

The shape of the electric contacts 12 may be suitably designed so as to be an optimum with respect to that of the mating objects. In the illustrated embodiment, the shape of the electric contacts 12 is hemispherical as shown in FIG. 1 because the mating IC pad is flat.

The electric contacts 12 which are not less than three are substantially concentrically arranged and equally spaced from one another in a manner that these electric contacts 12 are brought into contact with one pad of an integrated circuit. The size of the electric contacts 12 may be suitably designed so that all the electric contacts 12 could contact the pad within its size. In the illustrated embodiment, the diameter of the pad is 1.5 mm and the distance from the through-hole 14 to each of the electric contacts 12 is 0.4 mm. As the at least three electric contacts 12 are concentrically arranged and equally spaced from one another so that they can contact one pad as described above, the following advantage can be obtained. Even if the electric contacts are brought into contact with an integrated circuit pad in a manner that the through-hole 14 does not correctly coincide with the center of the pad, there are electric contacts 12 located at larger distance from the center of the pad and electric contacts 12 located at smaller distance from the center of the pad so that the mean distance between the center of the pad and the centers of the electric contacts 12 remains substantially the same, thereby minimizing irregularities in electric resistance value, impedance and skew.

This fact will be explained in more detail with four electric contacts by referring to FIG. 3. When the four electric contacts are displaced only in the direction of axis Y as shown in FIG. 3, there is little or no change in the electric resistance value as shown in Table 2, in spite of the variation in conductive path lengths from the center of the pad. In FIG. 3, positions a, b, c and d of the electric contacts 12 are moved only in the direction of axis Y downward as viewed in the drawing to new positions a', b', c' and d'. In the case that the four electric contacts 12 are moved in both the directions of axes X and Y, there is the same tendency, that is, little or no change in the electric resistance, although absolute values of the electric resistance values may be changed. In the case that the number of the electric contacts 12 is reduced to three or increased to more than 4, the same holds true although absolute values of the electric resistance values may be changed.

When the four electric contacts 12 concentrically arranged in a circle having a radius of 2 mm are moved only in the direction of axis Y, conductive path lengths to the electric contacts are calculated in the following manner. The conductive path lengths of the two points (c' and d') which may be longer than those of the other points are designated as follows. $\sqrt{(\sqrt{2}+y)^2+(\sqrt{2})^2}$ The conductive path lengths of the other points (a' and b') which may be shorter are designated as follows.

$$\sqrt{(\sqrt{2}-y)^2+(\sqrt{2})^2}$$

In this case, y is the moved distances.

The electric resistance value is denoted as follows.

$$\frac{\left(\sqrt{(\sqrt{2}+y)^2+(\sqrt{2})^2}\right)\left(\sqrt{(\sqrt{2}-y)^2+(\sqrt{2})^2}\right)}{2\sqrt{(\sqrt{2}+y)^2+(\sqrt{2})^2}+2\sqrt{(\sqrt{2}-y)^2+(\sqrt{2})^2}}$$

Table 1 shows variations in electric resistance values in the case of a single electric contact.

TABLE 1

| Displacement (b) | 0 | 0.2 | 0.5 | 1.0 | 1.2 | 1.4 |
|---|---|---|---|---|---|---|
| Resistivity | 1.0 | 0.95 | 0.88 | 0.75 | 0.70 | 0.65 |

TABLE 2

| Displacement (b) | 0 | 0.2 | 0.5 | 1.0 | 1.2 | 1.4 |
|---|---|---|---|---|---|---|
| Resistivity | 0.5 | 0.5 | 0.49 | 0.48 | 0.48 | 0.48 |

Figure 4:
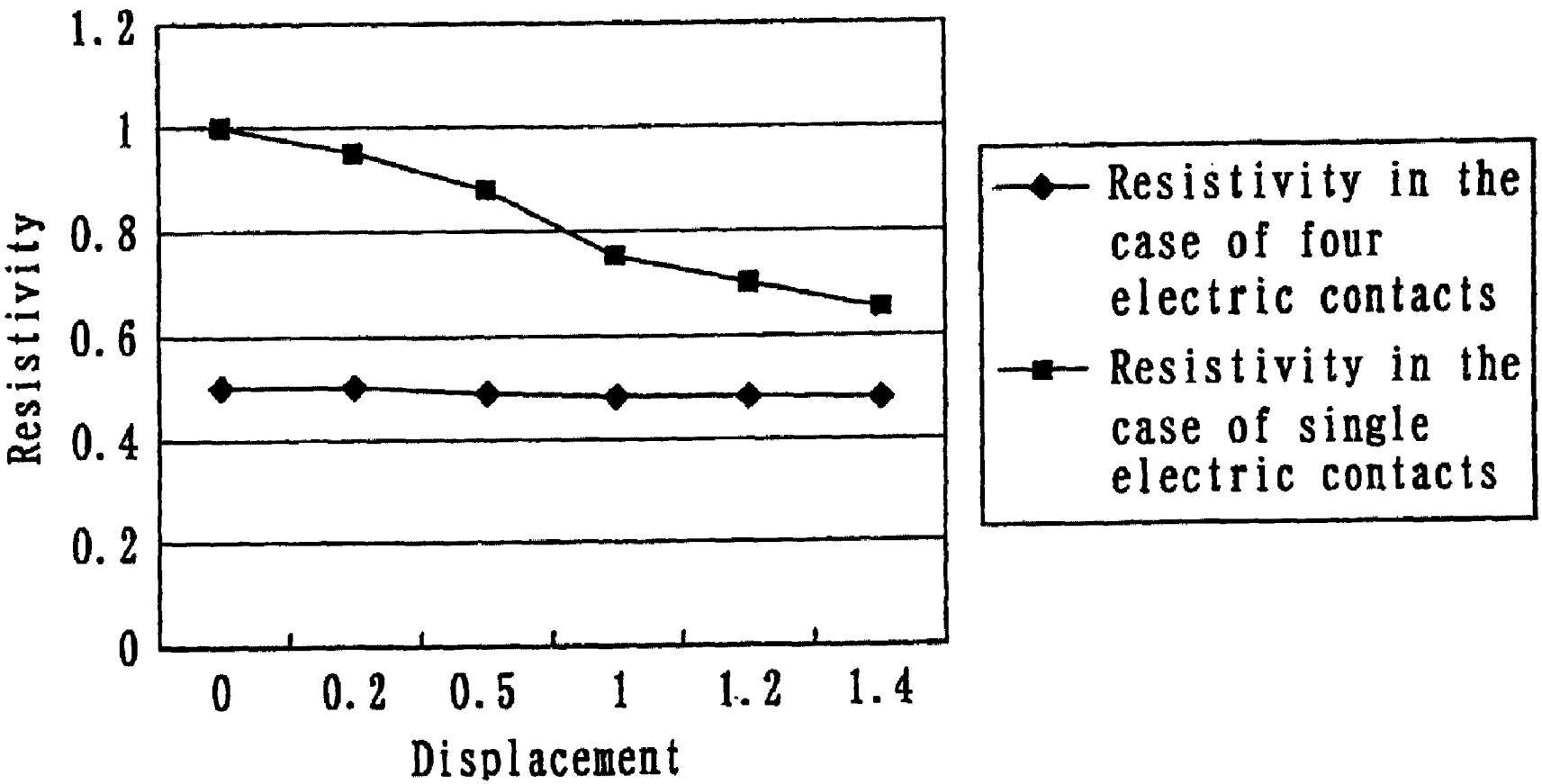
FIG. 4 is a graph of resistivity vs. displacement.

As can be seen from Table 2, the irregularities in electric resistance value are very little in comparison with the moved distance. This is also clearly evident in the graph in FIG. 4. The minimization of irregularities may be achieved by the fact that the electric contacts 12 are multiple contacts of not less than three, thereby achieving equalization of the conductive path lengths from the center of a pad to the electric contacts.

In comparison of Table 1 of only one electric contact 12 with Table 2 of the four electric contacts 12, it is clearly evident that the irregularities in electric resistance values with the four electric contacts are different from and smaller than those with the one electric contact. This is also obvious from the graph in FIG. 4.

The fine conductive wires 20 will then be explained. The fine conductive wires 20 are mad by the publicly known technique from a metal. The fine conductive wires 20 in the illustrated embodiment have a diameter of the order of 0.1 mm to 0.2 mm in consideration of electric conductivity and strength.

Preferred metals from which to form the fine conductive wires include, for example, brass, beryllium copper, phosphor bronze, pure copper, pure silver, pure gold and the like in consideration of soldability, stiffness and conductivity.

The fine conductive wires 20 extend straight through the elastomer 22 and perpendicular thereto and embedded therein. Either, or both, of the ends of each of the fine conductive wires 20 are connected to the through-hole 14. Each of the fine conductive wires 20 may be inserted into the through-hole 14 and connected thereto, or may be connected to the through-hole 14 without being inserted thereto. The shape of the fine conductive wires 20 may be suitably designed in consideration of conductivity, electric resistance, strength and the like and may be in the form of a straight pin or a pin having a reduced diameter portion or portions. The diameter of the fine conductive wires 20 may be suitably designed in consideration of conductivity and pitch of the electric contacts 12.

Finally, the elastomer 22 will be explained. The elastomer 22 has the fine conductive wires 20 inserted and embedded therein. The elastomer 22 is formed with a recess 26 at the periphery of each through-hole in which the fine conductive wire 20 is embedded. The length of the fine conductive wires 20 may be substantially the same as or slightly longer than the thickness of the elastomer 22 so that both the ends of the fine conductive wires 20 extend from both the surfaces of the elastomer 22.

As the elastomer 22 is formed with recesses 26 at the peripheries of the through-holes in which the fine conductive wires 20 are embedded as described above, the elastomer 22 is prevented from swelling at the ends of the fine conductive wires 20 which would otherwise occur. Therefore, the shoulders of the fine conductive wires 20 are never covered by the elastomer so that the lengths of the fine conductive wires may not be needed to be strictly controlled, thereby enabling the lengths of the conductors to be just as large as or approximately 0.05 mm to 0.1 mm larger than the thickness of the elastomer 22.

The shape of the recesses 26 may be in the form of a bowl or cone surrounding the through-hole and, as other examples, a stepped annular groove, dovetail groove and other various shapes. In general, any shapes may be used for the recesses 26 insofar as the recesses 26 are capable of preventing the elastomer 22 from swelling at the ends of the through-holes and able to ensure contact areas required for soldering the fine conductive wires 20 and the through-holes 14 of the flexible printed circuit board 18. The size of the recesses 26 may be suitably designed in consideration of their functions, strength of the elastomer, and holding force for the fine conductive wires 20.

In the illustrated embodiment, as shown in FIG. 2 the flexible printed circuit board 18 is secured to one surface of the elastomer 22 and a hard board 30 is secured to the other surface of the elastomer. In more detail, the flexible printed circuit board 18 formed with the through-holes 14 comprises the electric contacts 12, on one surface of the board, adapted to contact a mating object, and conductors 24 each effecting the continuity between the electric contacts 12 and the through-hole 14. The flexible printed circuit board 18 is bonded to the elastomer 22 on its one surface such that the one ends of the plurality of the fine conductive wires 20 each coincide with the through-hole 14.

While the flexible printed circuit board 18 is secured to the elastomer on one side and a hard board 30 is secured to the other side in the illustrated embodiment, it will be apparent that two flexible printed circuit boards 18 may be secured to the opposed surfaces of the elastomer.

As can be seen from FIG. 1, the flexible circuit board 18 is formed with a substantially U-shaped slot in a manner surrounding each of the electric contacts 12 so that the electric contacts are resiliently supported by parts of the flexible board surrounded by the slit in a cantilevered manner. The electric contacts are thus resiliently supported so that the electric contacts 12 can easily follow possible inclination and unevenness of the integrated circuit pads, thereby effectively performing the inspection of integrated circuit pads.

As examples of the application of the invention, there are electric connectors 10 for inspecting integrated circuits for use in mobile phones and the like. The electrical connector according to the invention can perform the inspection to minimize irregularities in repeatedly measured values of electric resistance value, impedance and skew even if measuring positions are displaced relative to the center of the integrated circuit pad when measuring.

While the invention has been particularly shown and described with reference to the preferred embodiment thereof, it will be understood by those skilled in the art that the foregoing and other changes in form and details can be made therein without departing from the spirit and scope of the invention.

What is claimed is:

1. An electrical connector comprising:

an elastomer in the form of a layer;

a plurality of fine conductive wires embedded in said elastomer and extending rectilinearly in vertical directions to front and rear surfaces of said elastomer, said fine conductive wires having an overall length substantially the same as the thickness of said elastomer so that both ends of each fine conductive wire extend from said front and rear surfaces of the elastomer; and a flexible printed circuit board connected to said fine conductive wires, and said flexible printed circuit board including:

at least three electric contacts arranged substantially concentrically around and electrically connected to each of said fine conductive wires.

2. The electrical connector as set forth in claim 1, wherein said elastomer is formed with a recess at the periphery of a hole extending through the flexible printed circuit board in which each of said fine conductive wires is embedded.

3. The electrical connector as set forth in claim 2, wherein said flexible printed circuit board is connected to either or both of said front and rear surfaces of said elastomer.

4. The electrical connector as set forth in claim 1, wherein said flexible printed circuit board is formed with a substantially U-shaped slit around each of said electric contacts.

5. The electrical connector as set forth in claim 2, wherein said flexible printed circuit board is formed with a substantially U-shaped slit around each of said electric contacts.

6. The electrical connector as set forth in claim 1, wherein said at least three electric contacts are arranged on said flexible printed circuit board so as to contact one integrated circuit pad.

7. The electrical connector as set forth in claim 6, wherein said flexible printed circuit board is connected to either or both of said front and rear surfaces of said elastomer.

8. The electrical connector as set forth in claim 2, wherein said at least three electric contacts are arranged on said flexible printed circuit board so as to contact one integrated circuit pad.

9. The electrical connector as set forth in claim 8, wherein said flexible printed circuit board is connected to either or both of said front and rear surfaces of said elastomer.

10. The electrical connector as set forth in claim 4, wherein said at least three electric contacts are arranged on said flexible printed circuit board so as to contact one integrated circuit pad.

11. The electrical connector as set forth in claim 10, wherein said flexible printed circuit board is connected to either or both of said front and rear surfaces of said elastomer.

12. The electrical connector as set forth in claim 5, wherein said at least three electric contacts are arranged on said flexible printed circuit board so as to contact one integrated circuit pad.

13. The electrical connector as set forth in claim 12, wherein said flexible printed circuit board is connected to either or both of said front and rear surfaces of said elastomer.

14. An electrical connector comprising:

an elastomer in the form of a layer;

a plurality of fine conductive wires embedded in said elastomer and extending rectilinearly in vertical directions to front and rear surfaces of said elastomer, said fine conductive wires having an overall length slightly larger than the thickness of said elastomer so that both ends of each fine conductive wire extend from said front and rear surfaces of the elastomer; and a flexible printed circuit board connected to said fine conductive wires, and said flexible printed circuit board including:

at least three electric contacts arranged substantially concentrically around and electrically connected to each of said fine conductive wires.

15. The electrical connector as set forth in claim 14, wherein said flexible printed circuit board is formed with a substantially U-shaped slit around each of said electric contacts.

16. The electrical connector as set forth in claim 14, wherein said at least three electric contacts are arranged on said flexible printed circuit board so as to contact one integrated circuit pad.

17. The electrical connector as set forth in claim 14, wherein said elastomer is formed with a recess at the periphery of a hole extending through the flexible printed circuit board in which each of said fine conductive wires is embedded.

18. The electrical connector as set forth in claim 17, wherein said flexible printed circuit board is connected to either or both of said front and rear surfaces of said elastomer.

19. The electrical connector as set forth in claim 17, wherein said flexible printed circuit board is formed with a substantially U-shaped slit around each of said electric contacts.

20. The electrical connector as set forth in claim 17, wherein said at least three electric contacts are arranged on said flexible printed circuit board so as to contact one integrated circuit pad.

* * * * *